US009278391B1

(12) United States Patent
Baer et al.

(10) Patent No.: US 9,278,391 B1
(45) Date of Patent: Mar. 8, 2016

(54) DISPROPORTIONATION PRODUCTION OF NANO-METAL POWDERS AND NANO-METAL OXIDE POWDERS

(71) Applicants: Charles A. Baer, State College, PA (US); David A Baer, Allendale, NJ (US); Charles D Baer, Munhall, PA (US)

(72) Inventors: Charles A. Baer, State College, PA (US); David A Baer, Allendale, NJ (US); Charles D Baer, Munhall, PA (US)

( * ) Notice: Subject to any disclaimer, the term of this patent is extended or adjusted under 35 U.S.C. 154(b) by 250 days.

(21) Appl. No.: 13/957,827

(22) Filed: Aug. 2, 2013

Related U.S. Application Data

(60) Provisional application No. 61/679,765, filed on Aug. 5, 2012.

(51) Int. Cl.
*B22F 9/20* (2006.01)

(52) U.S. Cl.
CPC ..... *B22F 9/20* (2013.01)

(58) Field of Classification Search
None
See application file for complete search history.

(56) References Cited

U.S. PATENT DOCUMENTS

| | | | | |
|---|---|---|---|---|
| 2,184,705 | A * | 12/1939 | Willmore | 75/678 |
| 2012/0055285 | A1* | 3/2012 | Mercuri et al. | 75/362 |
| 2013/0009089 | A1* | 1/2013 | Auvinen et al. | 252/62.55 |
| 2013/0069006 | A1* | 3/2013 | Zhou et al. | 252/301.4 H |
| 2013/0155581 | A1* | 6/2013 | Mchugh et al. | 361/509 |

* cited by examiner

*Primary Examiner* — George Wyszomierski
(74) *Attorney, Agent, or Firm* — John J. Elnitski, Jr.

(57) ABSTRACT

A method of producing nano-metal powder by providing a process metal to be processed. Selecting a metal halide identical to the process metal. Placing the process metal and selected metal halide in a controlled environment so that vapor from the selected metal halide can contact and react with the process metal. Heating the selected metal halide to a selected temperature to achieve vaporization of the selected metal halide at a desired vapor pressure, wherein the selected temperature controls the evaporation rate of the selected metal halide and the rate the nano-metal powder is formed. Heating the process metal to a temperature below the melting point of the process metal. Providing contact between the vapor of the selected metal halide and the process metal to form the nano-metal powder and reform the selected metal halide.

15 Claims, 6 Drawing Sheets

DISPROPORTIONATION PRODUCTION OF NANO-METAL POWDERS AND NANO-METAL OXIDE POWDERS

This application claims the benefit of and incorporates by reference U.S. Provisional Application No. 61/679,765 filed Aug. 5, 2012

BACKGROUND

The present invention generally relates to the production of nano-metal and metal oxide powders. More specifically, the present invention relates to production of nano-metal and metal oxide powders by use of improved disproportionation technology.

The current disproportionation process was adapted for the purification of aluminum, U.S. Pat. No. 2,184,705. In this process, the disproportionation is carried out at a temperature above the melting point of the process metal in order to achieve the resulting purified metal product. In the use of the process for the production of nano-metal and metal oxide powders, the disproportionation process is carried out at a temperature that is below the melting point of the process metal in order to produce the nano-metal powders.

Magnetic nano iron and magnetic nano iron oxide powders are currently produced through the use of vapor condensation, plasma technology, laser ablation, gel processing, chemical precipitation, mechanical milling, or thermal spray technology. As shown in FIG. 1, the low evaporation rate of iron illustrates the low rates that are achieved even at high process temperatures. These technologies provide a mechanism by which small quantities of the nano powders can be produced for medical applications, research and development, and other special applications. The cost of nano-metal powders produced through these technologies is excessively high due to the cost of process materials, labor, power requirements and capital equipment. A more efficient process is needed to produce nano-metal powder from aluminum, nickel, iron, titanium, chromium, and other similar metals in large quantities and at reduced costs.

It is an object of the present invention to provide a process to produce nano-metal powder from aluminum, nickel, iron, titanium, chromium, and other similar metals in large quantities and at reduced costs.

SUMMARY OF THE INVENTION

A method of producing nano-metal powder by providing a process metal to be processed. Selecting a metal halide identical to the process metal. Placing the process metal and selected metal halide in a controlled environment so that vapor from the selected metal halide can contact and react with the process metal. Heating the selected metal halide to a selected temperature to achieve vaporization of the selected metal halide at a desired vapor pressure, wherein the selected temperature controls the evaporation rate of the selected metal halide and the rate the nano-metal powder is formed. Heating the process metal to a temperature below the melting point of the process metal. Providing contact between the vapor of the selected metal halide and the process metal to form the nano-metal powder and reform the selected metal halide.

DETAILED DESCRIPTION

Figure 1:
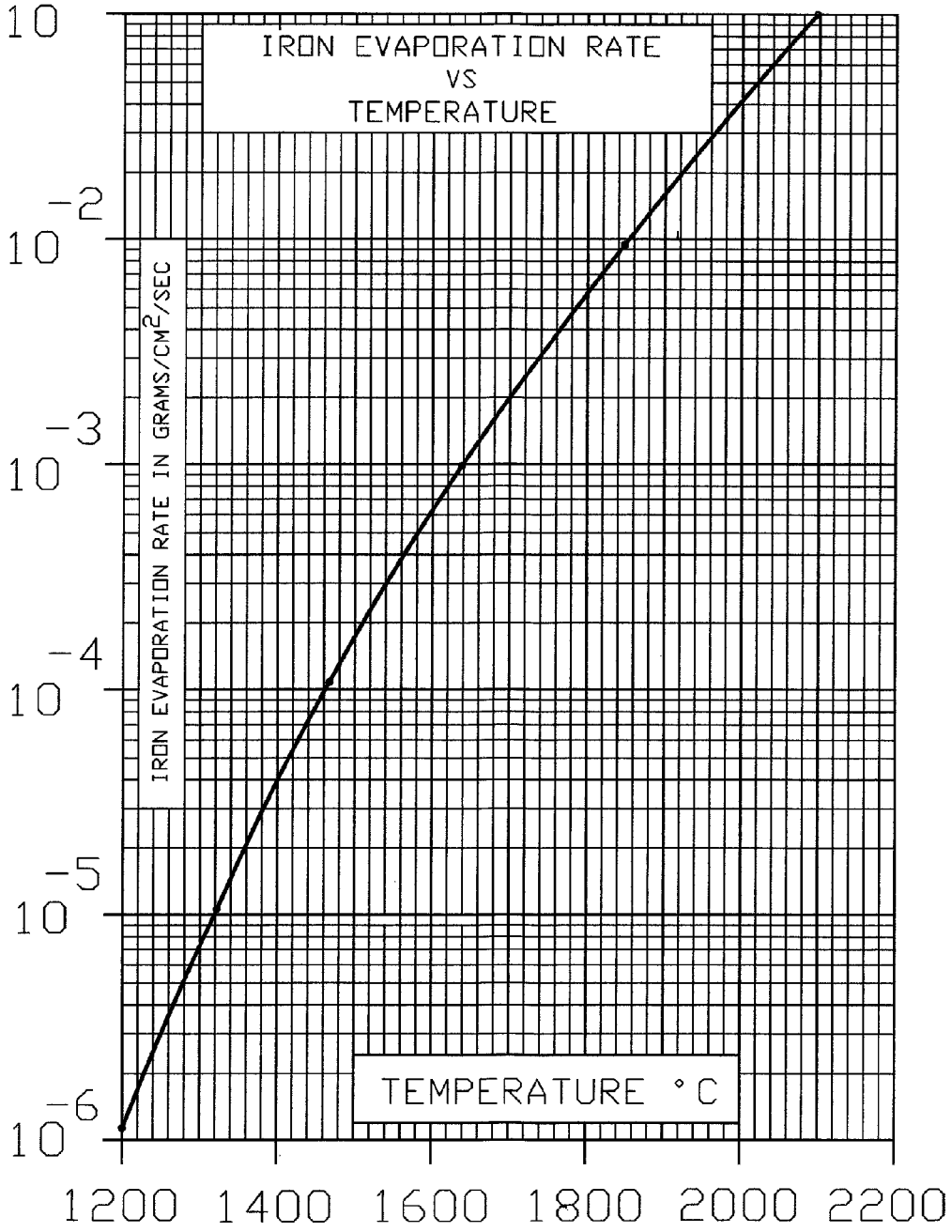
FIG. 1 is a graph of iron evaporation rate vs. temperature according to the present invention.

The present invention is an improved disproportionation process for producing nano-metal powders and nano-metal oxide powders. Disproportionation is a redox reaction in which an element in one oxidation state forms two species with different oxidation levels. The improved disproportionation process for the production of nano-metal powders can best be defined as a chemical reaction between a process metal and an identical metal bi-halide or higher halide. The chemical reaction is under a controlled atmosphere and at an elevated temperature that is below the melting point of the metal to be processed. The metal to be processed will be referred to as the "process metal". The resulting reaction produces an unstable, transient, metal mono-halide which then reforms into the initial metal bi-halide and a process metal particle which separates from the reaction as the nano-metal powder to be formed. The ability to produce metal powders such as nano iron and iron oxide in commercial quantities economically, allows for use in such applications as ground contamination remediation, nano iron sheet, and potential oil and gas recovery. The process of the present invention is also applicable to the production of other nano-metal powders such as aluminum and nickel for 3-D printing and fabrication of complex machine parts and structural components. None of the prior art technologies currently available meet the economic requirements to produce nano-metal powders in great quantities. The nano-powder formed by the process offers a number of specific advantages for a group of nano-metal powders. These advantages include lower processing temperatures; the use of metal alloys, metal scrap, and commercial purity metals for the processing metal; recycling of the process reactant; improved process economics; and rates thousands of times higher than those achieved through vapor phase condensation of the nano-metal powders.

The processing operation involves the exposure of the process metal to an identical metal halide under controlled pressures and temperatures. The nano-metal powders that can be produced by this process are limited to those metals that have +2 or higher valences. Metals in this category include aluminum, nickel, iron, titanium, chromium, and other similar metals. The metal halides which can be used for the processing include the chlorides, fluorides, bromides, and iodides of the process metal. The selection of the optimum halide is dependent upon economics, the physical properties of the halide such as vapor pressure, melting point, boiling point, sublimation temperature, and decomposition temperatures when applicable. One should be aware that all the metal halides are toxic compounds, especially when in the vapor state. Suitable protective equipment should be used when handling these materials. The process requires that the process metal, iron for example, which is to be converted into a nano-metal powder, is to be heated in a vacuum or controlled atmosphere and exposed to the halide vapor. The halide is heated to the selected temperature to achieve the desired vaporization. The selection of the temperature to which the halide is heated is selected by the operator as the reactant vapor temperature will determine the vapor pressure of the halide and the evaporation rate of the halide. This determines the rate at which the nano-metal powder is formed. Increasing the vapor temperature will increase the rate of metal powder formation. Decreasing the vapor temperature of the halide will decrease the powder formation rate. As the metal halide vapor contacts the process metal, there is a very high rate of formation of an intermediate iron mono-halide which then disproportionates to eject the purified metal atoms and reform the initial metal halide for repeated recycling and reaction with the process metal. The iron halides and nano iron and iron oxide powders produced by the disproportionation process are of primary interest.

For the iron example, the iron chlorides $^{\Delta}FeCl_3$, $FeCl_2$, and FeCl exhibit very different thermal behaviors. $FeCl_3$ begins to decompose into $FeCl_2$+$Cl_2$ at its melting point of 577° K (304° C.). By contrast, $FeCl_2$ has a much higher thermal stability and can be distilled unchanged at its normal boiling point of 1297° K (1024° C.). FeCl is known spectroscopically, in that it exists only in the dilute gas phase and is quite unstable toward disproportionation. On the basis of the above data, the successive addition of chlorine atoms to iron, the first bond formed is relatively weak, the second bond forming $FeCl_2$ is significantly stronger, and the third bond forming $FeCl_3$ is again weak. The calculated heats of formation of these iron chlorides species in the gas phase at 298.15° K are +45.3 kcal/mol for FeCl, −35.8 kcal/mol for $FeCl_2$, and −66.8 kcal/mol for $FeCl_3$. With the Heat of Formation of FeCl being endothermic (+45.3 KCal/mol), it is necessary to provide sufficient energy to form the mono-chloride by reacting the $FeCl_2$ vapor with the iron, at a sufficiently high temperature and vapor pressure to initiate the mono-halide formation.

The Heat of Formation of the $FeCl_2$ is exothermic (−35.8 Kcal/mol), which subsequently provides the additional energy for the disproportionation reaction to occur. With the application of heat, the iron in the reactant is oxidized and the iron (II) ion from the vapor reactant is reduced, forming iron (I) chloride vapor. This compound is unstable and as its temperature is reduced, the more stable iron (II) chloride reforms, together with elemental iron. Because this reaction occurs below the melting point of iron (1811 K), the resulting particulate does not fuse into a larger mass and remains useful for the envisioned applications. The following disproportionation reaction equation is typical using $FeCl_3$:

$$2Fe_{(solid)}+FeCl_{3(vapor)}[+\Delta T]=3FeCl_{(vapor)}[-\Delta T]=2Fe_{(solid)}+FeCl_{3(vapor)}$$

Or, if $FeCl_2$ is used as the reactant:

$$Fe_{(solid)}FeCl_{2(vapor)}[+\Delta T]=2FeCl_{(vapor)}[-\Delta T]+Fe_{(solid)}+FeCl_{2(vapor)}$$

The resulting disproportionation of the mono-halide is dependent upon reducing the mono-halide vapor process temperature to achieve the disproportionation through the reformation of the $FeCl_{2(vapor)}$ and the decomposition of the $FeCl_{(vapor)}$. The temperature and energy of heat of Formation of $FeCl_2$ is sufficient to reform the $FeCl_2$ from the FeCl vapor and initiate the disproportionation. There is not sufficient energy alone in the $FeCl_2$ that is formed to initiate the formation of the FeCl due to the high (+45.3 Kcal/Mol) Heat of Formation of FeCl. Hence, the further process reaction with the iron powder does not occur and the nano-metal powder is formed.

The resulting nano powders would be, essentially, pure, unoxidized metal powders. In order to oxidize the nano-metal powder to produce a nano-metal oxide, it is necessary to expose the metal to an oxidizing agent under controlled conditions so as to produce the desired degree of oxidation. This can be done as a separate processing step. By controlling the temperature of the nano-metal powder and reacting it with a selected oxidizing vapor, such as water vapor, or heated dry air at 200 degrees Celsius, a nano-metal oxide can be formed with the desired properties. These characteristics may include paramagnetic properties, chemical resistance to a wide range of reactants, radiological opacity, particle size, particle shape, low bulk density, and product economics. The oxidation equation for the nano iron oxide powder is:

$$2Fe_{(solid)}+3H_20_{(vapor)}[+\Delta T]=Fe_20_{3(solid)}+3H_{2(gas)}$$

This oxidation phase of the process is handled as a separate operation by exposing the nano iron powder to water vapor, or other suitable oxidizing agent.

The disproportionation process can be conducted as a batch process in which a specific quantity of the process metal is used in the process. Also, the process can be semi-continuous with incremental quantities of the process metal being continuously inserted into the system for maintaining the disproportionation process until the process metal feed is consumed. The semi-continuous approach is obviously the more efficient method for conducting the disproportionation process.

Figure 2:
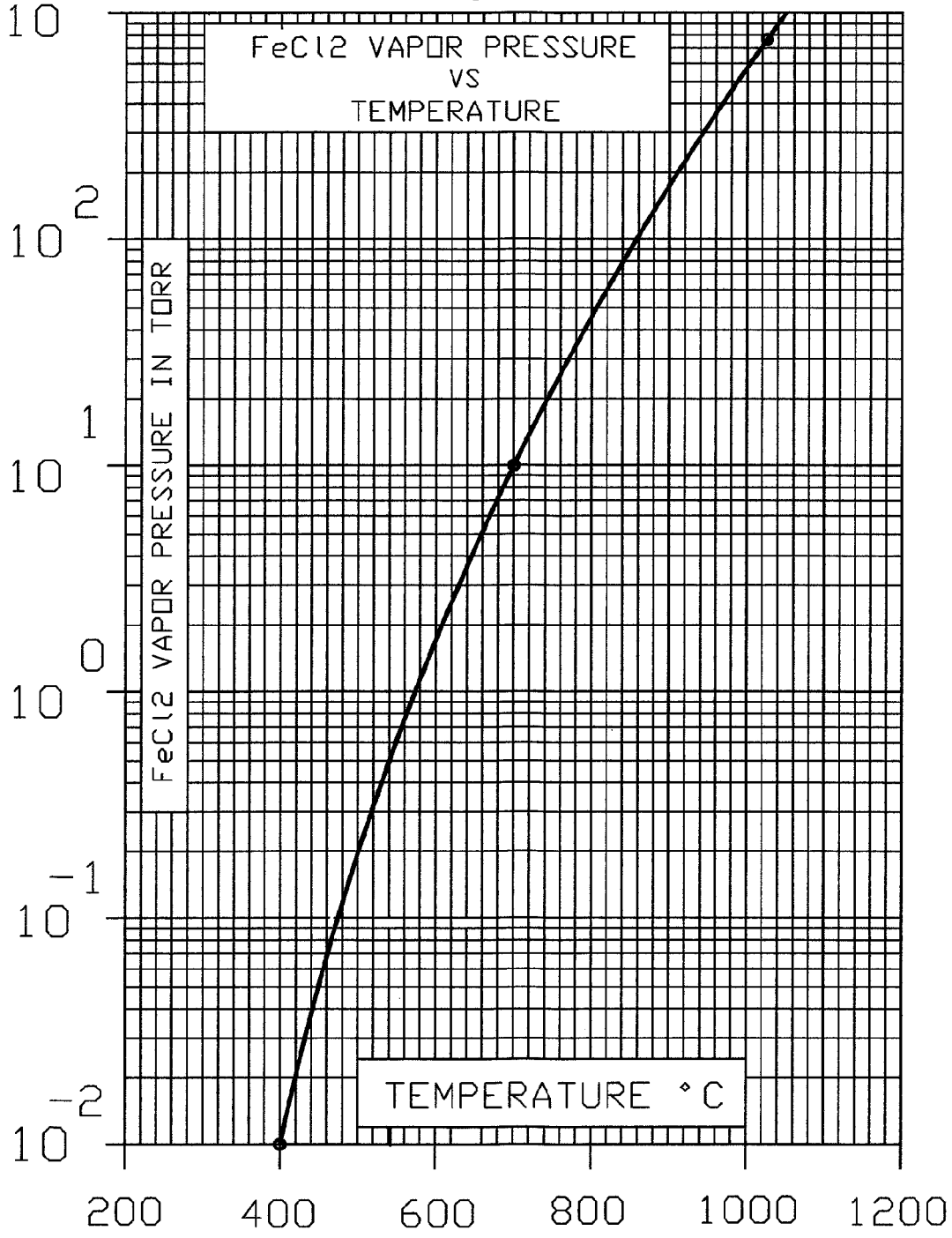
FIG. 2 is a graph of $FeCl_2$ vapor pressure vs. temperature according to the present invention.
Figure 3:
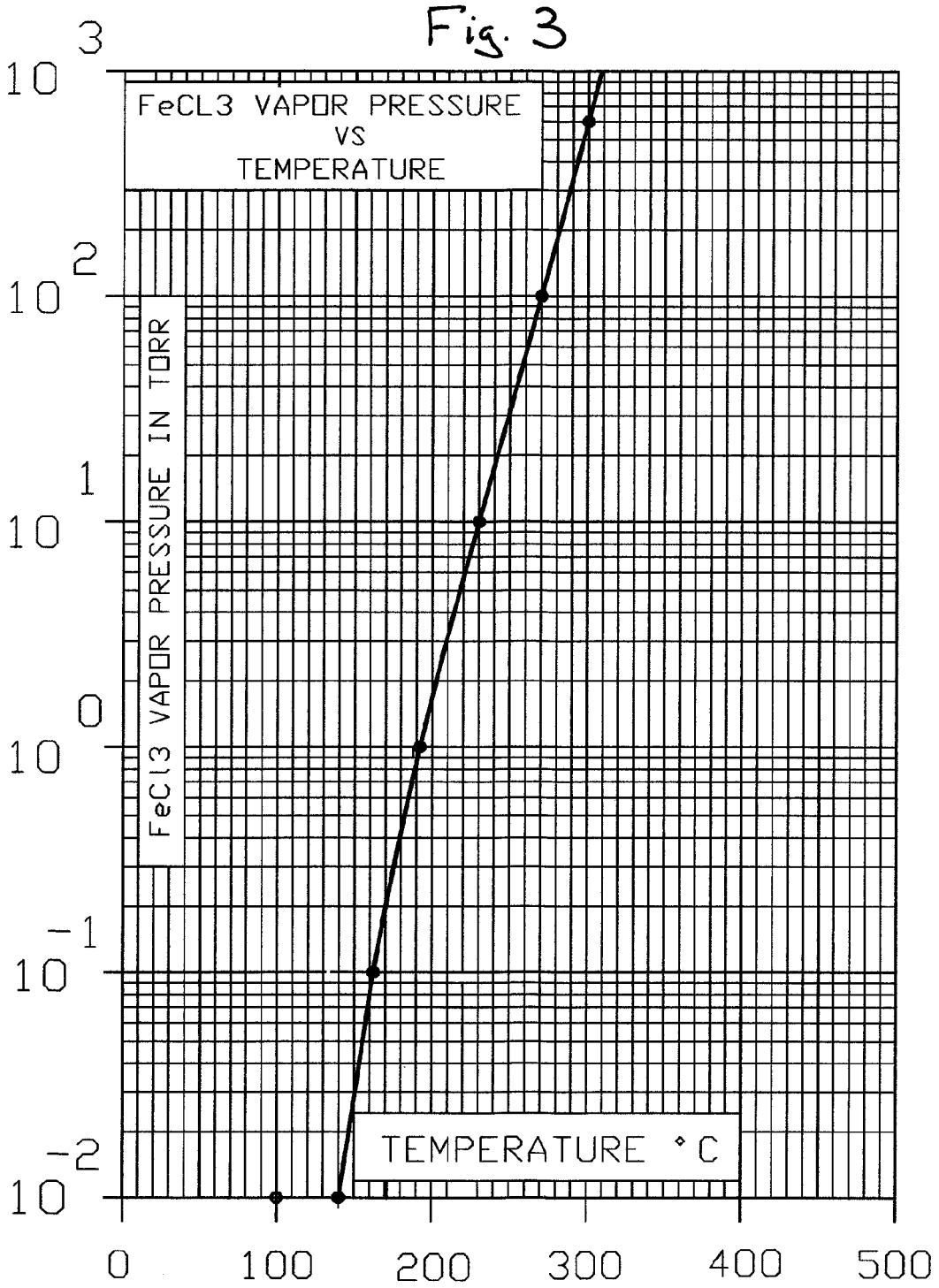
FIG. 3 is a graph of $FeCl_3$ vapor pressure vs. temperature according to the present invention.
Figure 4:
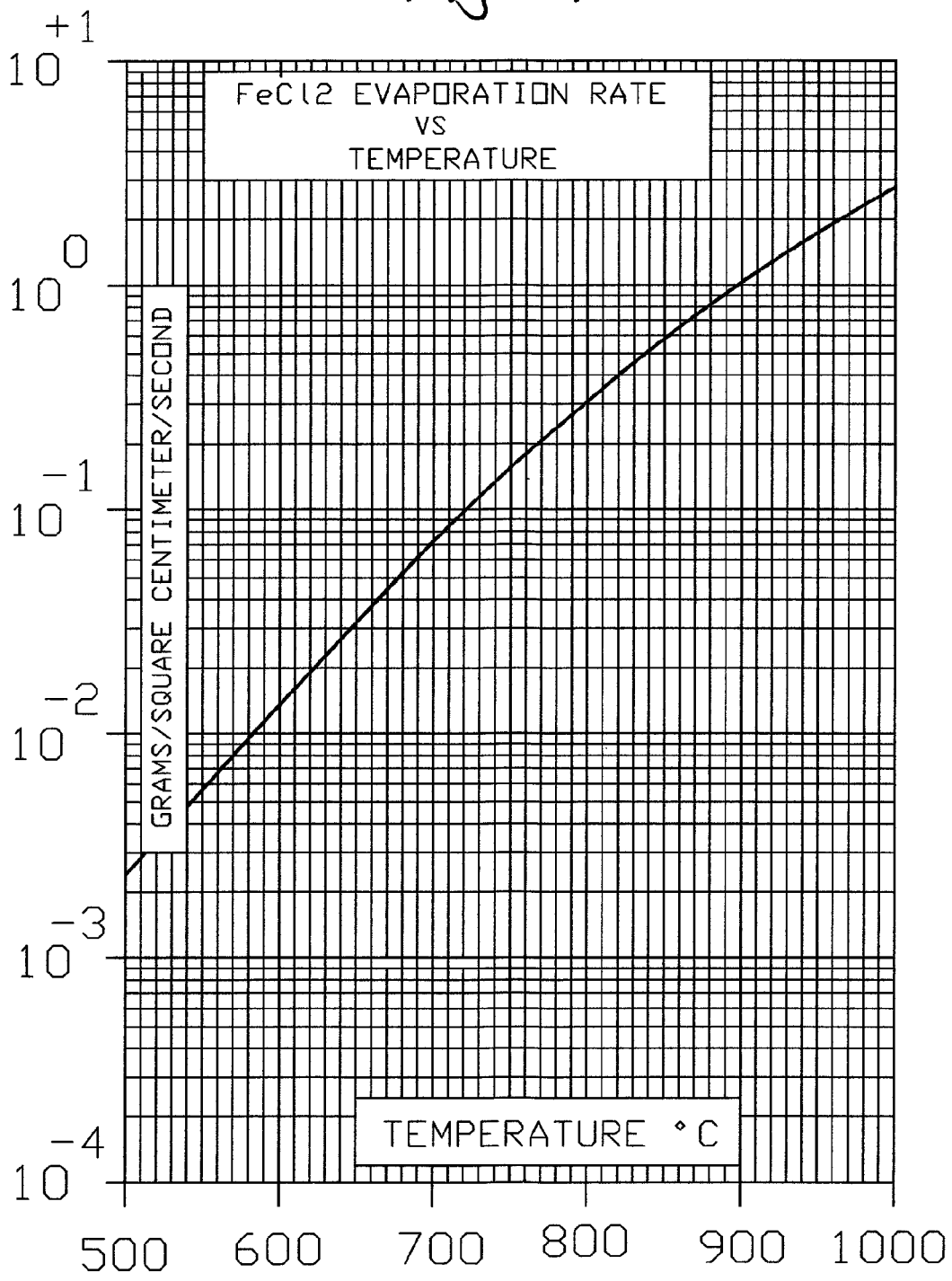
FIG. 4 is a graph of $FeCl_2$ evaporation rate vs. temperature according to the present invention.

Vapor pressure curves are shown for $FeCl_2$ in FIG. 2 and $FeCl_3$ in FIG. 3 to illustrate the respective comparative vapor pressures in *Torr for each versus temperature in degrees Celsius. It is immediately apparent that the use of $FeCl_3$ as the reactant vapor is limited to a maximum temperature of nominally 315 degrees Celsius, as exceeding this temperature results in the decomposition of the $FeCl_3$ to $FeCl_2$ and ½ $Cl_2$. With the lower temperature vapor pressure limitation and the low decomposition temperature associated with $FeCl_3$, the reactant halide is not suitable for the disproportionation process, unless one wishes to use the $FeCl_3$ as an in-process substitute for the $FeCl_2$ reactant. The use of $FeCl_2$ vapor as the reactant vapor permits the use of higher processing temperatures to achieve an effective high rate of disproportionation. The evaporation rate of the $FeCl_2$ as a function of temperature is shown in FIG. 4. It is not necessary to operate the system at temperatures above the boiling point of the halide reactant to provide the necessary vapor to react with the process metal.

Figure 5:
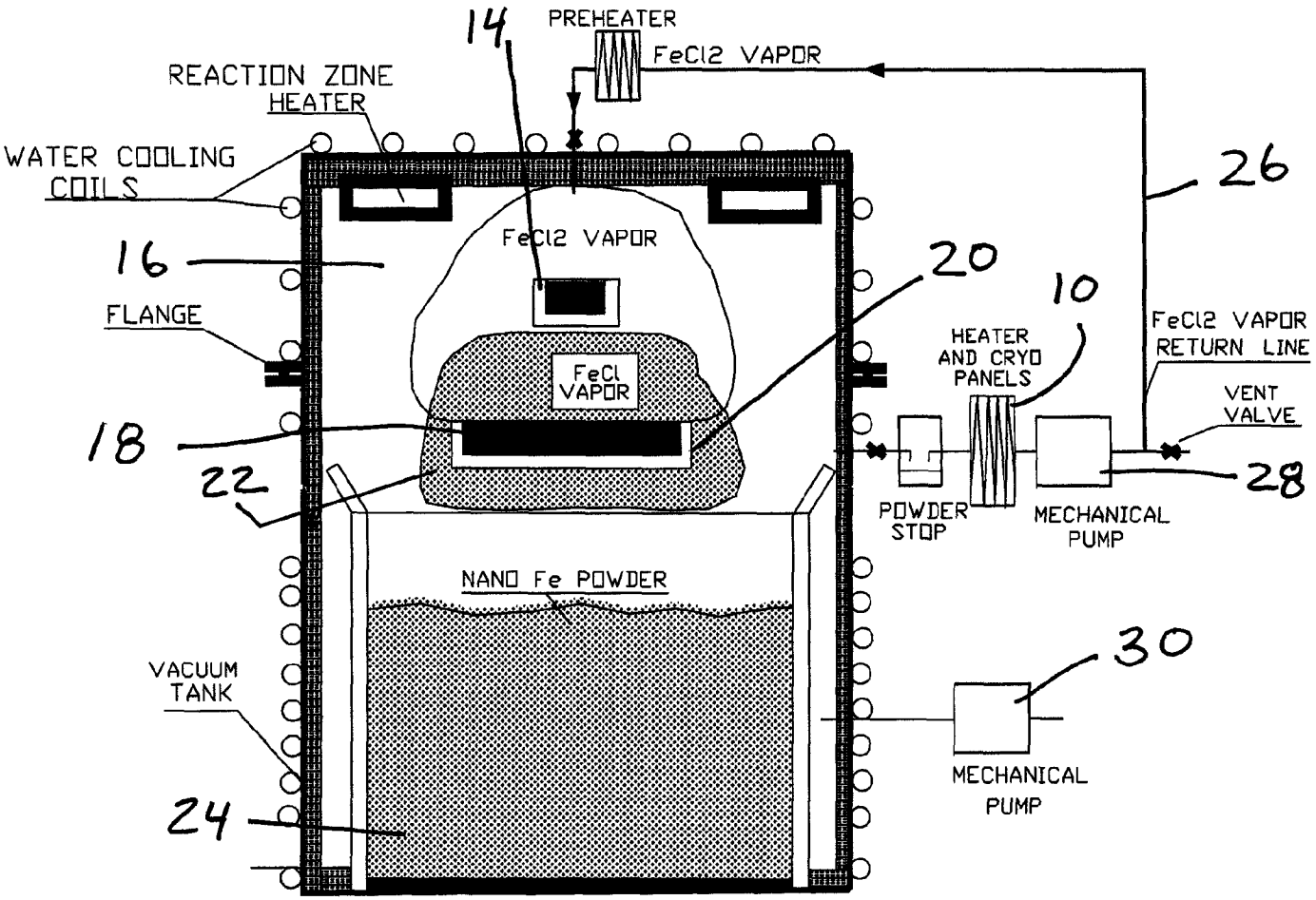
FIG. 5 is a schematic of disproportionation process in a chamber according to the present invention.

A schematic drawing in FIG. 5 shows an example to illustrate the fundamental steps in the disproportionation process. The schematic illustrates the general process steps, and the basic process chamber requirements necessary to provide the vapor feeds; reactant flow for recycling; the required decrease in process temperature to initiate the disproportionation of the mono-chloride and pumping requirements. The processing chamber can be fabricated from stainless steel and have aluminum silicate board insulation panels mounted on the inner surface of the chamber to minimize heat loss to the chamber walls. Water cooling coils are mounted on the outer surface of the chamber to provide heat dissipation and eliminate thermal damage to seals and valves. As the halogen reactant is extremely toxic, there is a necessity to provide a mechanism to isolate and contain the halogen reactant so that any systems or process problems that might develop could be repaired or replaced under safe conditions. By incorporating cryogenically cooled panels in the recycling line heating and cooling panel tank 10, the recycling line provides a way for evacuating the chamber and drawing all the gases into contact with the cryogenically cooled panels. All condensable gases are frozen on contact with the panels and the reactant gas retained as a solid until the panels are warmed up and the gases vaporized for return in the system. The cryogenically cooled gases are further isolated by closing the valves to the system.

The cryogenically cooled panels are designed to be cooled by liquid nitrogen when necessary to freeze out the halogen reactant for chamber isolation.

As an example of the full process, the first step is to take the process metal, scrap iron for instance, and break down the process metal into granules with a nominal dimension of 5 mm, so as to provide increased surface area for the reaction. The process metal is placed in the heating unit and the temperature set to maintain the process metal at 1200 degrees Celsius. FIG. 1 illustrates the basic evaporation rate for iron as a function of temperature. The reactant halide $FeCl_2$, is selected so as to operate the process at an efficient temperature and achieve a high rate of disproportionation from the reactant vapor pressure. The reactant 12, $FeCl_2$, is heated in a reactant crucible 14 to 700 degrees Celsius in the reaction zone 16 to vaporize the reactant and to achieve a vapor pressure of 10 Torr for the process reaction, as indicated in FIG. 2. The process metal 18 is heated in the process metal crucible 20 to 1200 degrees Celsius. The reaction of the halogenated reactant and the process metal produces a vapor cloud 22 comprised of the mono-halogenated metal, $FeCl_{(vapor)}$. The temperature of the mono-halogenated FeCl decreases as it vaporizes from the surface of the process metal and disproportionates and nano-metal powder 24 (nano-iron powder) is formed and the halogenated reactant, $FeCl_2$ is reformed. If the reactant moves away from the processing zone it is recycled 26 back to the initial processing zone by the recycling pump 28. A second vacuum pump 30 is used for the evacuation of the processing chamber to eliminate any residual moisture in the system prior to initiating the disproportionation process and maintaining the chamber operating pressure.

The rate of the disproportionation reaction is achieved through the control of the following factors: Process metal heater surface area; Temperature of the process metal; Particle size of the process metal; Total process metal surface area; Temperature of the reactant vapor; Mass flow rate of the reactant vapor and Iron feed rate into the chamber. At a processing temperature of 700 degrees Celsius, the vapor pressure is 10 Torr for the halide reactant, $FeCl_2$. The calculated vaporization rate is 0.21054 grams of $FeCl_2/cm^2$/second, which for a 50 square centimeter vaporization source corresponds to a nano-iron powder production rate of 36 pounds/hour. The nominal bulk density of the powder is 12 pounds per cubic foot. At this production rate the volume of the nano-iron powder would be 3 cubic feet/hour. The calculation of the evaporation rate "W" in grams/$cm^2$/second from the solid or liquid phase is shown in the following equation:

$$W=5.83\times10^{-2}P_V(M/T)^{0.5}$$

Figure 6:
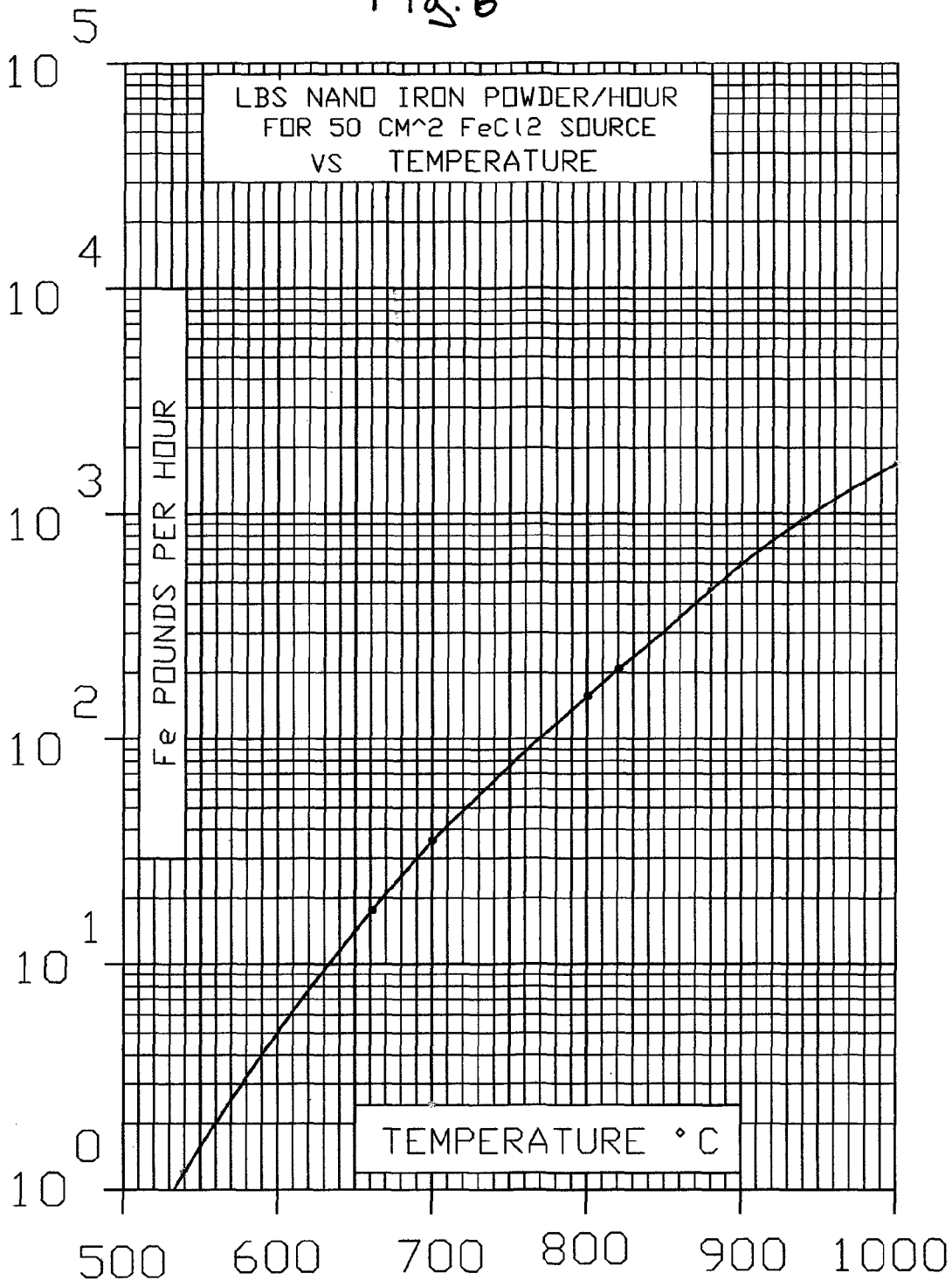
FIG. 6 is a graph of the rate in pounds of nano-iron powder produced vs. temperature according to the present invention.

Where, W=Rate in grams/$cm^2$/second, $P_V$=Vapor pressure in Torr, M=Molecular weight and T=Temperature in degrees Kelvin. The plot of the production rate of the nano-iron powder in pounds per hour as a function of the reactant vapor temperature is shown in FIG. 6. This illustrates the production rate based on the first iteration of the $FeCl_2$ vapor reaction. The final production rate will be dependent upon the number of iterations that occur between the repetitively reformed $FeCl_2$ and the hot process metal and will be very significantly higher than the initial value calculated for the reactant vapor temperature.

While different embodiments of the invention have been described in detail herein, it will be appreciated by those skilled in the art that various modifications and alternatives to the embodiments could be developed in light of the overall teachings of the disclosure. Different embodiments can include different ways to form a secure box that includes a sliding mount plate on the inside surface of the cover plate. There can be different forms of locks to move the sliding mount plate. There can be different shaped device openings and device mounting plates to accommodate differences in devices to be mounted to the secured ceiling device system. Accordingly, the particular arrangements are illustrative only and are not limiting as to the scope of the invention that is to be given the full breadth of any and all equivalents thereof.

We claim:

1. The method of producing nano-metal powder below a melting point of a process metal using a disproportionation process, comprising:

providing a process metal to be processed into a nano-metal powder;

selecting a metal halide of the process metal in order to expose the selected metal halide to the process metal;

placing the process metal and selected metal halide in a controlled environment so that vapor from the selected metal halide can contacts and reacts with the process metal;

heating the selected metal halide to a selected temperature to achieve vaporization of the selected metal halide at a desired vapor pressure, wherein the selected temperature controls the evaporation rate of the selected metal halide and the rate the nano-metal powder is formed;

heating the process metal to a temperature below the melting point of the process metal; and providing contact between the vapor of the selected metal halide and the process metal to form the nano-metal powder and reform the selected metal halide.

2. The method of claim 1, further including capturing the reformed selected metal halide and recycling the reformed selected metal halide to be heated and contact remaining process metal to form additional nano-metal powder and reform the selected metal halide.

3. The method of claim 1, further including removing residual moisture from a vacuum chamber as part of the controlled environment.

4. The method of claim 1, further including reducing the process metal to less than 5 mm in size prior to placing the process metal in the controlled environment.

5. The method of claim 1, wherein the selected metal halide has at least a +2 valence.

6. The method of claim 1, further including conducting the disproportionation process as a batch process.

7. The method of claim 1, further including conducting the disproportionation process as a semi-continuous process with incremental quantities of the process metal being continuously inserted into the controlled environment for maintaining production of nano-metal powder.

8. The method of claim 1, wherein selecting the metal halide comprises considering the following physical properties of the metal halide: vapor pressure, melting point, boiling point, sublimation temperature and decomposition temperatures and further comprising considering economics.

9. The method of claim 1, wherein the metal halide is one of the following:

chlorides, fluorides, bromides, and iodides of the process metal.

10. The method of claim 1, wherein process metal is one of the following:

aluminum, nickel, iron, titanium and chromium.

11. The method of claim 1, wherein the controlled environment is a vacuum.

12. The method of claim 1, further including exposing the nano-metal powder produced to an oxidizing agent under controlled conditions so as to produce a desired degree of oxidation to produce a nano-metal oxide powder.

13. The method of claim 12, wherein the nano-metal powder is oxidized by controlling the temperature of the nano-metal powder and reacting nano-metal powder with water vapor.

14. The method of claim 12, wherein the nano-metal powder is oxidized by controlling the temperature of the nano-metal powder and reacting nano-metal powder with heated dry air at 200 degrees Celsius.

15. The method of claim 1, wherein the process metal is iron and the metal halide is $FeCl_2$.

* * * * *